US005580017A

United States Patent [19]

Larson

[11] Patent Number: 5,580,017

[45] Date of Patent: Dec. 3, 1996

[54] DISPLAY DEVICE

[76] Inventor: Douglas B. Larson, 1109 Minnesota St. West, Cannon Falls, Minn. 55009

[21] Appl. No.: 282,099

[22] Filed: Jul. 28, 1994

Related U.S. Application Data

[63] Continuation of Ser. No. 171,499, Dec. 22, 1993, abandoned.

[51] Int. Cl.[6] ..... A47F 5/00

[52] U.S. Cl. ..... 248/221.11; 248/220.31

[58] Field of Search ..... 248/221.11, 220.31, 248/231.31, 220.41; 211/59.1

[56] References Cited

U.S. PATENT DOCUMENTS 4,029,282 6/1977 Dauth ..... 248/221.1
4,606,466 8/1986 Fredrickson ..... 211/59.1
4,610,413 9/1986 Pedersen ..... 248/220.3
4,961,504 10/1990 Larson ..... 248/220.4 X

*Primary Examiner*—Ramon O. Ramirez
*Assistant Examiner*—Sarah L. Purol

[57] ABSTRACT

A peg bar display device includes an elongate rectangular channel for retaining a plurality of display pegs therein. An interior area of the rectangular channel receives an elongate stop that rests on the pegs within the channel interior area for preventing rotation thereof. A straddle support is also shown having a central upper rod and a pair of lower rods below and extending on either side of the central rod parallel thereto. The straddle support provides for supporting products thereon wherein right and left symmetrical portions of the product straddle the upper rod on either side thereof and where bottom ends of the right and left portions rest on the lower rods.

22 Claims, 5 Drawing Sheets

DISPLAY DEVICE

This is a continuation of application Ser. No. 08/171,499, filed Dec. 22, 1993, now abandoned.

BACKGROUND OF THE INVENTION

1. Field of the Invention

The present invention relates to display devices, and in particular peg bar type display devices.

2. Background

Various types of peg bar display devices are known in the art, as seen for example in U.S. Pat. Nos. 4,610,413, 4,961,504, and 5,114,021, the contents of which are incorporated herein by reference thereto. As is taught therein a horizontally supported rectangular channel rod includes a plurality holes for releasably receiving elongate pegs therein. The pegs provide for a relatively inexpensive means for suspending of a plurality of retail goods therefrom.

A problem has been found with such pegs wherein, though they are prevented from being pulled directly out from the supporting channel rod, they can rotate therein. Such rotation typically presents no problem if there exists only the singular peg. However if the peg has an attachment that extends therefrom, such as a price label support, there will be an increased tendency for the peg to rotate due to incidental contact with the extending attachment. Thus, in the case of a peg having price label support, the label may not be presented to the customer in the desired horizontal orientation wherein it is easily read and aesthetically pleasing.

Accordingly, it would be desirable to have a peg bar display wherein the pegs can be prevented from rotating as well as prevented from being pulled out from their supports.

A further problem with such pegs concerns their limitations with respect to their ability to display certain types of products. Individual display pegs generally contemplate the suspending therefrom of the goods being sold. Typically, the product will have a centrally located tab on the exterior top surface of the packaging thereof, the tab having a hole through which the peg extends. Thus, there will oftentimes be some space lost due to the height of the tab. This situation can be a concern where multiple parallel horizontal rows of the product are contemplated, but where the space allocated to the product is particularly limited. Also, suspended products can easily move or swing beneath the peg bar, which movement may be unwanted due to a physical aspect of the product itself, or for product presentation concerns. In addition, certain products, due to their size or weight, do not lend themselves well to suspending from an individual peg.

Accordingly, it would be desirable to have a display device for certain types of products where the amount of product displayed over a given vertical surface area is maximized, and where such products are firmly held in place.

SUMMARY OF THE INVENTION

A locking mechanism for preventing rotation of a peg bar display is shown. The display system includes a horizontally extending rectangular channel having a plurality of oblong holes therein. The holes provide for receiving of a display peg. The display peg has a insertion end having a flattened portion wherein the flattened portion has a width dimension greater than the normal diameter of the peg and greater than a width dimension of the channel hole yet less than a height dimension of the channel hole. Thus, as is known, the pegs can be inserted into the channel holes when the flattened portion is aligned with the height of the channel hole. After insertion therein, the peg is rotated 90 degrees wherein the flattened portion is of a greater dimension than the width of the channel hole, and subsequently can not be withdrawn. When so inserted, the peg divides the interior of the channel into an upper and lower cavity. The present invention utilizes an elongate stop which is inserted into the upper cavity above the level of the pegs. The elongate stop is sized to contact an upper flat portion of each peg and an interior surface of the rectangular channel for preventing any rotation of the pegs.

In a further embodiment a straddle peg is shown. The straddle peg includes a plate attachment end sized to cooperatively fit over the rectangular channel. The attachment plate has a top horizontal surface and a bottom horizontal lip spaced from each other in a vertical direction. The top surface has an upper rod secured on one end centrally thereof and extending outwardly therefrom to a downwardly extending L-shaped end portion thereof. Open ends of a U-shaped rod are secured to the lower lip wherein the U-shaped rod extends therefrom parallel to and below the upper rod, and where the L-shaped end portion of the upper rod is secured centrally of the closed end of the U-shaped rod.

An example of use for the straddle product display of the present invention concerns food products, such as pudding, sold in single serving containers where two or more of the containers are held together and constitute the retailed package. Typically, four of the containers are held together by a partial packaging wrap in two layers of two, one directly on top of the other. In addition, the containers are generally made of a clear plastic and the two lower most containers extend below the packaging wrap so that the contents thereof can be seen. There will also generally exist a cleavage or separation space between the lower containers. The present invention takes advantage of this space wherein the upper rod extends therein between the lower containers, and the bottoms of each container then rest on the lower U-shaped rod. In this manner, the product package "straddles" the upper rod and is supported thereby and is supported by the lower rod. Thus, such a product is firmly supported and held in place, is not subject to unwanted movement thereof and can be easily and quickly loaded thereon by the retailers and removed therefrom by their customers.

DESCRIPTION OF THE DRAWINGS

A further understanding of the structure function, operation, and advantages of the present invention can be had by referring to the following figures wherein.

DETAILED DESCRIPTION OF THE INVENTION

Figure 1:
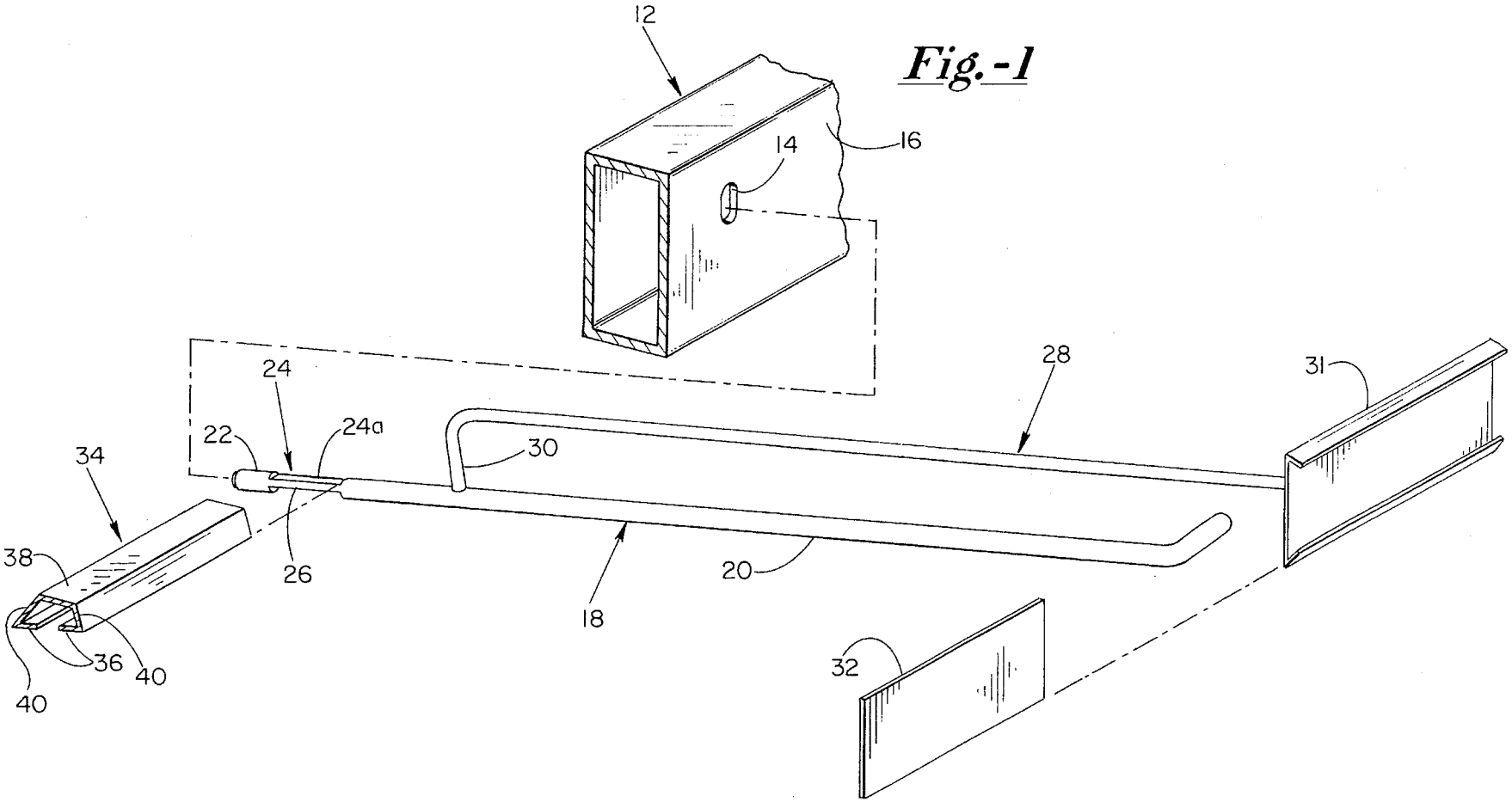
FIG. 1 shows an exploded perspective view of the present invention.
Figure 2:
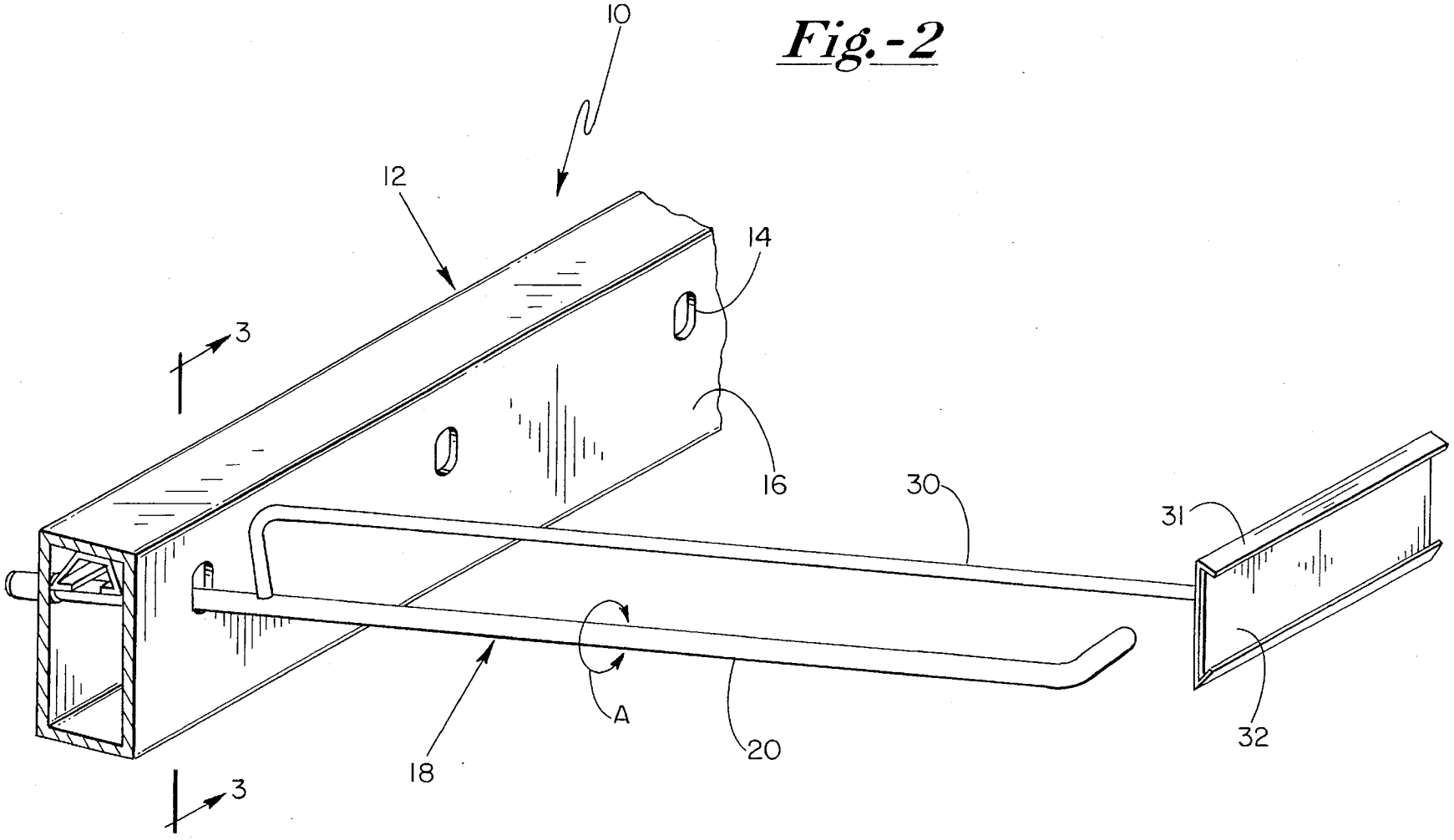
FIG. 2 shows a perspective view of the present invention.
Figure 3:
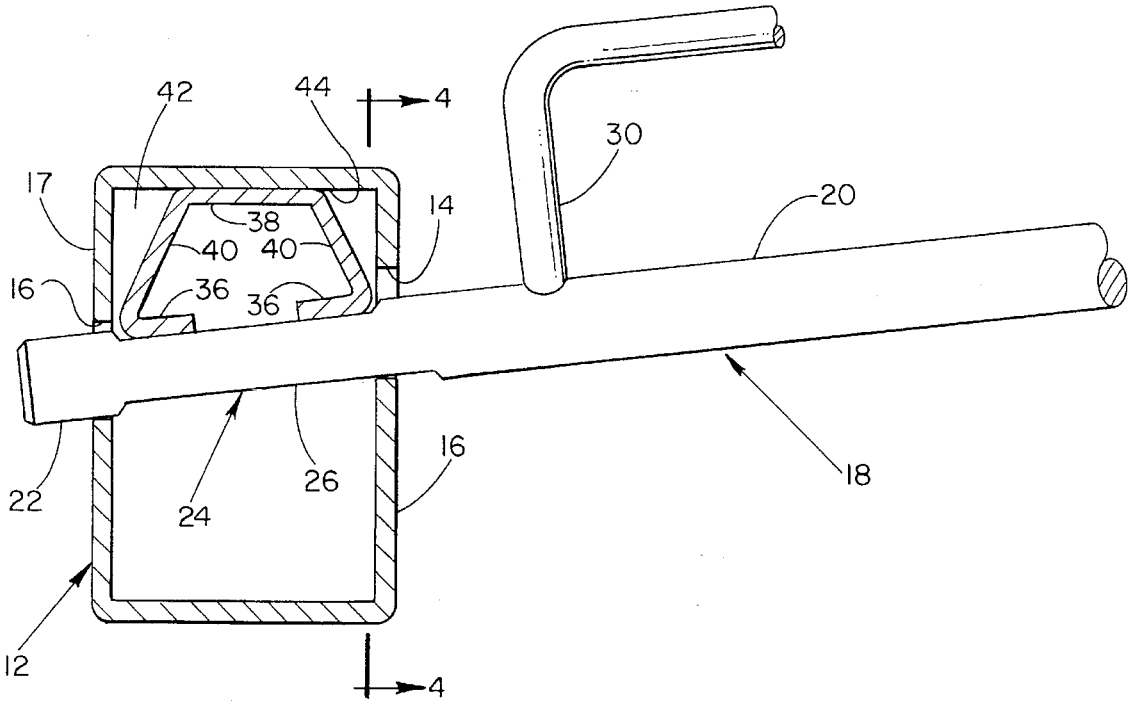
FIG. 3 shows a side plan view along FIG. 3—3 of FIG. 2.
Figure 4:
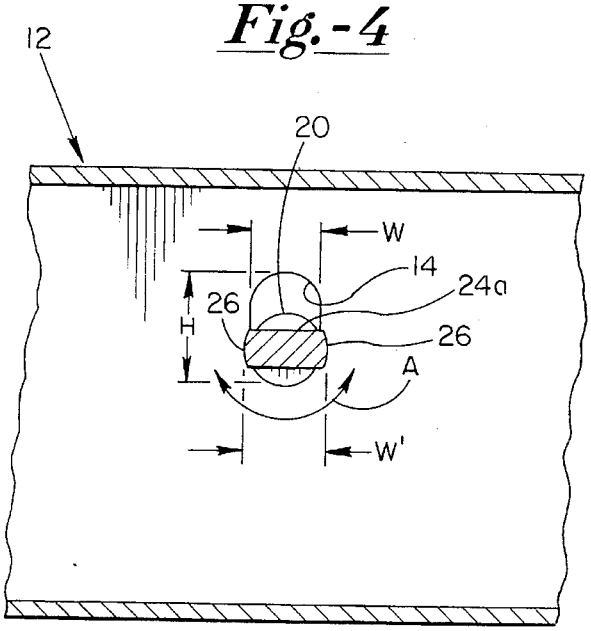
FIG. 4 shows a cross-sectional view along lines 4—4 of FIG. 3.

As seen by referring to FIGS. 1–4, the display device of the present invention is generally indicated by the numeral 10. Display 10 includes an elongate rectangular channel 12 having a plurality of partially oval shaped orifices 14 extending through a front surface 15 thereof and a plurality of corresponding round orifices 16 extending along a back surface 17 thereof. Orifices 14 have a flat bottom edge 14*a* and have a height dimension indicated by the letter H and a width dimension indicated by the letter W. Peg 18 includes an elongate object supporting portion 20 and an insertion end 22. Insertion end 22 includes a flattened portion 24 having a flat top surface 24*a* and a flat bottom surface 24*b*. Flattened portion 24 has a width W' extending between edges 26. A price tag display holder 28 includes an L-shaped leg 30 secured to peg 18 adjacent to end 22 thereof and includes a price display portion 30 for receiving a price tag 32.

An elongate peg rotation stop 34 includes a pair of flanges 36 and a top end 38. Sides 40 extend between and connect legs 36 and top surface 38. It will be appreciated by those of skill that stop 34 can be made of a strip of sheet metal suitably bent to form flanges 36, sides 40 and top 38.

In operation, channel 12, as is known in the art, is supported horizontally by a support means, not shown, and pegs 18 are retained within channel 12. The insertion of a peg 18 requires first orienting flat portion 24 so that edges 26 thereof extend vertically and allow for insertion of end 22 through hole 14, as the width W' thereof is less than the height H. Once inserted wherein end 22 extends outwardly of rear hole 16, peg 18 is rotated 90 degrees so that flattened portion 24 extends horizontally wherein the width W' thereof is greater than the width W of hole 14. Thus, the width W' of flat portion 24 prevents peg 18 from being pulled through hole 14. It will be appreciated by those of skill that the contact between flat surface 24*b* and hole edge 14*a* serve to somewhat prevent rotation of peg 18 around its elongate axis indicated by arrow A in FIG. 4. However, that resistance to rotation is easily overcome especially where peg 18 has a portion extending therefrom such as price display 28. Physical contact with display 28 during loading or removal of product on peg 18 can cause such rotation with the result that display tag 32 will not be positioned in the desired level or horizontal orientation. Therefore, stop 34 is inserted within an upper space 42 within channel 12 and above pegs 18 to prevent such rotation. Specifically, the bottom flanges 36 thereof closely contact flat surface 24*a* and top end 38 closely contacts an inner top surface 44 of channel 12. It can be appreciated that the insertion of stop 34 thereby prevents any rotation of the pegs 18 around the axis thereof by filling space 42 in a manner that stop 34 can not move whereby peg 18, in turn, can not rotate.

Figure 5:
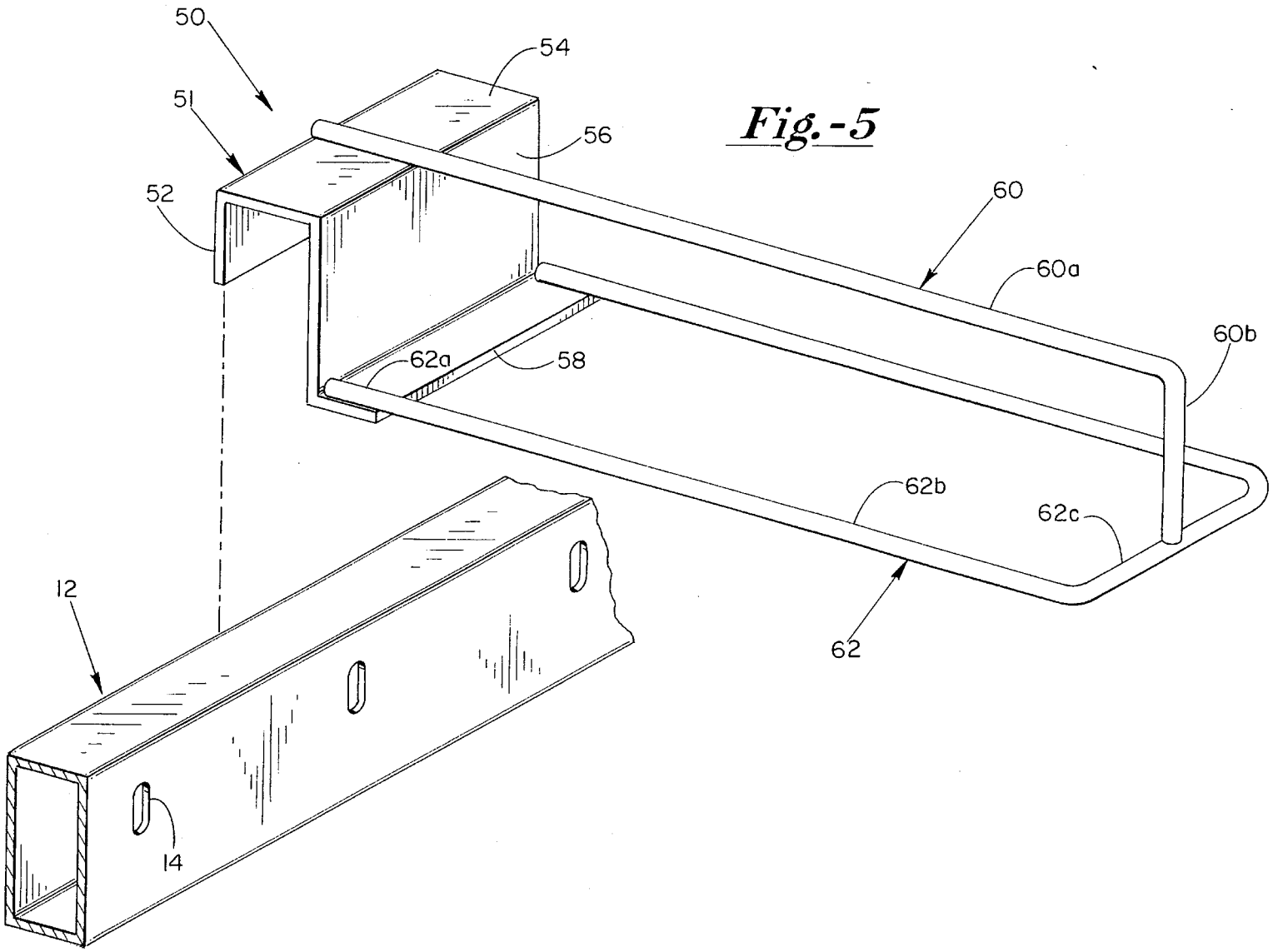
FIG. 5 shows an alternate embodiment of the present invention.
Figure 6:
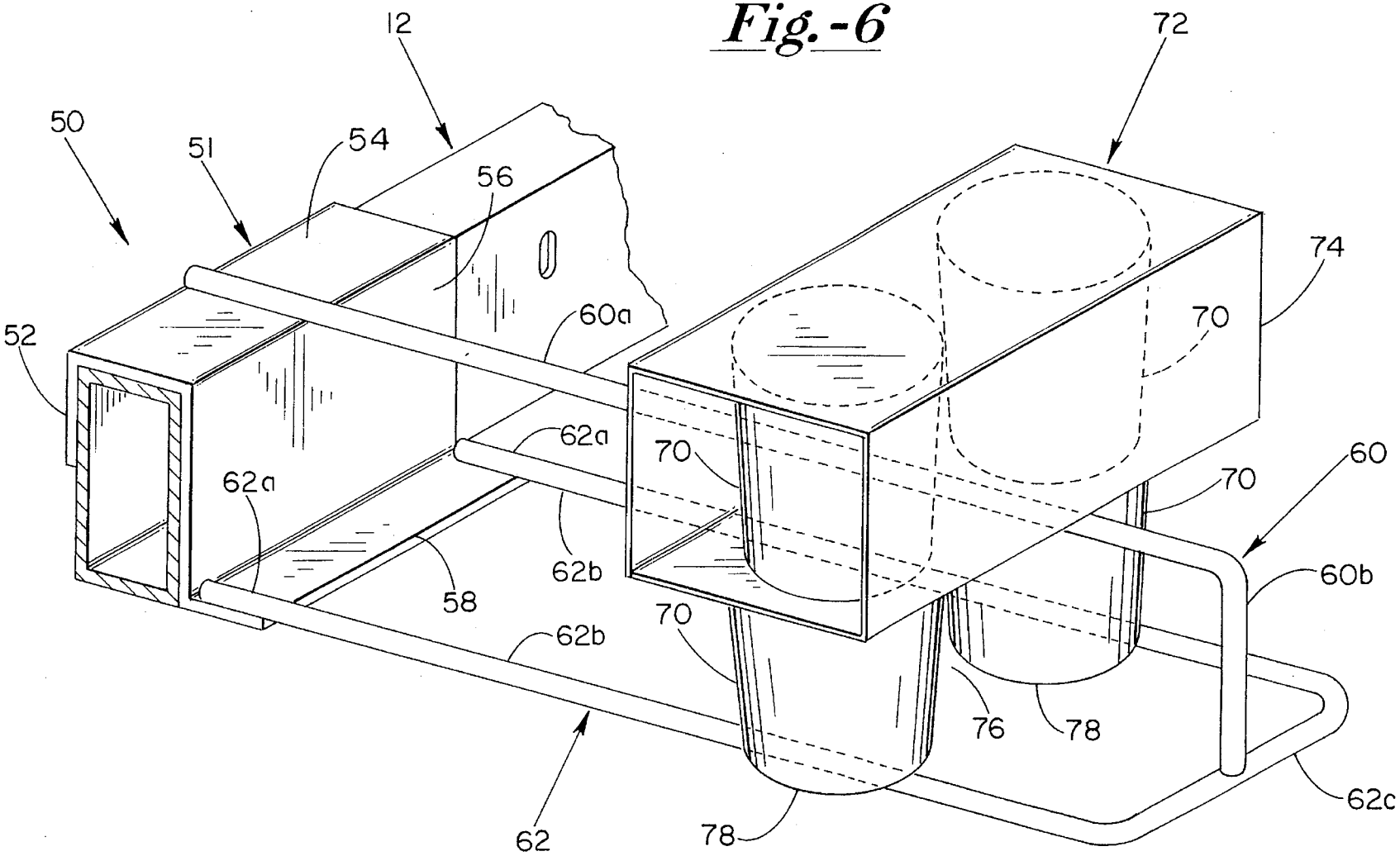
FIG. 6 shows an environmental perspective view of the alternate embodiment of the present invention.

As seen by referring to FIGS. 5 and 6, a display support is shown and generally referred to by the numeral 50. Support 50 includes a retaining end having a rear attachment plate 51. Plate 51 includes a rear vertical portion 52 a top horizontal portion 54, a front vertical portion 56 and a lower horizontal lip portion 58. An upper rod 60 is secured to top surface 54 centrally thereof and extends therefrom. Rod 60 includes an elongate horizontal portion 60*a* and a short vertical portion 60*b*. A U-shaped rod 62 is secured to lower lip 58 on opposite ends thereof by two open ends 62*a* of parallel rods 62*b*, and is secured to vertical portion 60*b* of upper rod 60 centrally of a closed end portion 62*c* thereof.

In operation it can be seen that support 50 is held by placement of plate 50 fitting over a rectangular channel, such as channel 12. Of course, holes 14 are not required nor do they perform any function in the use of support 50. An example of use for support 50 involves food products, such as pudding, sold in single serving containers 70 where two or more of the containers 70 are held together and constitute the entire retail package 72. Typically, four of the containers are held together by a partial packaging wrap 74 in two layers of two, one directly on top of the other. In addition, containers 70 are generally made of a clear plastic and the two lower most containers 70 extend below packaging 74 so that the contents thereof can be seen. There will also generally exist a cleavage or separation space 76 between the lower containers 70. The present invention takes advantage of this space wherein upper rod portion 60*a* extends in space 76 between lower containers 70, wherein bottoms 78 of each container then rest on respective lower parallel rod portions 62*b*. In this mariner, product package 72 "straddles" upper rod 60 and is supported thereby, and is supported by lower parallel rod portions 62*b*. Thus, such a product 72 is firmly supported and held in place, is not subject to unwanted movement thereof and can be easily and quickly loaded on support 50 by the retailers and removed therefrom by their customers. In addition, it can be understood that support 50 can be easily moved along channel 12 to any position there along so as to easily and quickly adapt to the support of a wide variety of differently shaped products. Moreover, the support means, such as horizontally supported channels 12, can be spaced apart one above the other so as to most efficiently use the vertical space allotted to product 72.

I claim:

1. A support device for supporting and displaying a plurality of objects thereon, comprising:

an elongate support bar, the support bar having an external perimeter surface defining an internal support bar space, and the support bar having one or more first holes extending there through along a front surface portion of the external perimeter surface, the one or more first holes each having a first diametric dimension and a second diametric dimension transverse thereto and the first diametric dimension greater than the second diametric dimension, one or more support pegs for suspending the objects therefrom, the one or more support pegs each having an extended portion on a first end thereof, each extended portion extending beyond a nominal width dimension of each one or more peg and sized so that a maximum cross-sectional dimension thereof is less than the first diametric dimension of the one or more first holes but greater than the second diametric dimension thereof whereby each extended portion of each one or more peg first end can be inserted into the internal support bar space through the one or more first holes when each one or more peg is oriented in a first position after which each one or more peg is then rotatable to a second position wherein the extended portions thereof prevent each one or more peg from being withdrawn from each one or more hole, and a rotation stop means, the stop means being elongate and sized for insertion into the internal support bar space for contacting the first ends of the one or more pegs and for contacting an interior surface portion of the support bar so that each one or more peg is prevented from rotating from the second position.

2. The device as defined in claim 1, and the extended portion comprising a relatively flat co-planar flange area adjacent each peg first end.

3. The display device as defined in claim 1, and the support bar having one or more second holes extending along a rear surface portion of the support bar and aligned with the first holes.

4. The display device as defined in claim 3, and the maximum cross-sectional diameter of each extended portion being greater than a maximum diametric dimension of each second hole.

5. The display device as defined in claim 1, and each first hole having a flat bottom perimeter portion so that a portion of each co-planar flange area rests thereon.

6. The display device as defined in claim 1, and the stop means having a first elongate surface along the length thereof for contacting an inner surface of the support bar internal support bar space and a second elongate surface along the length thereof for contacting a surface area of each extended portion.

7. The display device as defined in claim 1, and each peg having a display means secured thereto and extending therefrom for retaining display indicia thereon adjacent the peg second end.

8. The display device as defined in claim 2, and the support bar having one or more second holes extending along a rear surface portion of the support bar and aligned with the first holes.

9. The display device as defined in claim 8, and the maximum cross-sectional diameter of each extended portion being greater than a maximum diametric dimension of each second hole.

10. The display device as defined in claim 9, and each first hole having a flat bottom perimeter portion so that a portion of each co-planar flange area rests thereon.

11. The display device as defined in claim 10, and the stop means having a first elongate surface along the length thereof for contacting an inner surface of the support bar internal support bar space and a second elongate surface along the length thereof for contacting a surface area of each extended portion.

12. The display device as defined in claim 9, and each peg having a display means secured thereto and extending therefrom for retaining display indicia thereon adjacent the peg second end.

13. A display device for supporting and displaying a plurality of objects thereon, comprising:

an elongate substantially rectangular channel bar, the channel bar having top and bottom ends opposite from each other and front and back ends extending opposite from each other and substantially parallel from each other and the channel bar top, bottom, front and back ends defining an interior space, and the channel bar supportable so that the front end is held in a substantially vertical orientation, a plurality of elongate object support pegs, each support peg having an elongate body extending between a first end and a second end thereof, and the first end having an extension means adjacent thereto and extending from the elongate body thereof, and the channel bar front end having a plurality of oblong holes extending there through, and the channel bar back end having a plurality of second holes extending there through and in a corresponding alignment with each of the oblong holes, and the oblong holes each having a first diametric dimension and a second diametric dimension transverse thereto and the first diametric dimension greater than the second diametric dimension, and each stop means extending beyond a nominal width dimension of each peg and sized so that a maximum cross-sectional dimension thereof is less than the first diametric dimension of the oblong holes but greater than the second diametric dimension thereof so that when each peg is oriented in a first position the extension means thereof is insertable through an oblong hole whereby the peg first end is received in the corresponding second hole and the extension means is located within the channel bar interior space, and the peg then rotatable to a second position wherein the extension means thereof prevent each peg from being withdrawn from the oblong holes, and a rotation stop means, the stop means being elongate and sized for insertion into the channel bar interior space for contacting the extension means each peg and for contacting an interior surface portion of the channel bar so that each peg is prevented from rotating from the second position.

14. The display device as defined in claim 13, and the extension means comprising a relatively flat co-planar flange area adjacent each peg first end.

15. The display device as defined in claim 13, and each oblong hole having a flat bottom perimeter portion so that a portion of each co-planar flange area rests thereon.

16. The display device as defined in claim 13, and the maximum cross-sectional diameter of each extension means being greater than a maximum diametric dimension of each second hole.

17. The display device as defined in claim 13, and the stop means having a first elongate surface along the length thereof for contacting an inner surface of the channel bar interior space and a second elongate surface along the length thereof for contacting a surface area of each extension means.

18. The display device as defined in claim 13, and each peg having a display means secured thereto and extending therefrom for retaining display indicia thereon adjacent the peg second end.

19. The display device as defined in claim 14, and each oblong hole having a flat bottom perimeter portion so that a portion of each co-planar flange area rests thereon.

20. The display device as defined in claim 19, and the maximum cross-sectional diameter of each extension means being greater than a maximum diametric dimension of each second hole.

21. The display device as defined in claim 20, and the stop means having a first elongate surface along the length thereof for contacting an inner surface of the channel bar interior space and a second elongate surface along the length thereof for contacting a surface area of each extension means.

22. The display device as defined in claim 21, and each peg having a display means secured thereto and extending therefrom for retaining display indicia thereon adjacent the peg second end.

* * * * *